US006179191B1

(12) United States Patent
Chopp

(10) Patent No.: US 6,179,191 B1
(45) Date of Patent: Jan. 30, 2001

(54) WIRE ADVANCING APPARATUS AND METHOD

(75) Inventor: Joseph Chopp, Oxford, MI (US)

(73) Assignee: Molex Incorporated, Lisle, IL (US)

( * ) Notice: Under 35 U.S.C. 154(b), the term of this patent shall be extended for 0 days.

(21) Appl. No.: 09/363,022

(22) Filed: Jul. 29, 1999

(51) Int. Cl.[7] ..... B65H 20/00; B65H 20/24

(52) U.S. Cl. ..... 226/166; 226/112; 226/128; 226/167

(58) Field of Search ..... 226/4, 112, 115, 226/128, 149, 150, 165, 166, 167

(56) References Cited

U.S. PATENT DOCUMENTS

| | | | | |
|---|---|---|---|---|
| 2,460,340 | * | 2/1949 | Dickerman | 226/115 |
| 2,542,213 | * | 2/1951 | Schwarcz | 226/166 X |
| 3,881,246 | | 5/1975 | Folk . | |
| 4,176,448 | | 12/1979 | Zahn et al. . | |
| 4,590,788 | | 5/1986 | Wallis . | |
| 4,665,733 | | 5/1987 | Wallis . | |
| 4,881,317 | | 11/1989 | Brown . | |
| 4,912,823 | | 4/1990 | Shah et al. . | |
| 5,157,830 | | 10/1992 | Koch . | |
| 5,632,430 | | 5/1997 | Kato . | |
| 5,724,847 | | 3/1998 | Hite . | |

* cited by examiner

*Primary Examiner*—Michael R. Mansen
(74) *Attorney, Agent, or Firm*—Jones, Tullar & Cooper PC

(57) ABSTRACT

An apparatus for advancing one or more lengths of wire in consistent successive increments includes a pair of cooperating gripper members. A first gripper and a second gripper are provided for advancing the length of wire, and are slideably located within a slot. A reciprocating press assembly having inclined surfaces is used to motivate the grippers. The inclined surfaces are inserted between the grippers and force the grippers to move away from each other during the downstroke of the plunger. Springs force the grippers back toward each other, and aid in repositioning the grippers and moving the wire. While one gripper grips and advances the wire, the second gripper is repositioning and not gripping the wire. The press assembly activates and advances one gripper during a downstroke, and activates and advances the other gripper during an upstroke. Also, during the downstroke, one inactive gripper is repositioned, while on the upstroke, the other inactive gripper is repositioned. Thus, the invention moves the wire one incremental distance during the downstroke, and a second incremental distance during the upstroke.

20 Claims, 9 Drawing Sheets

WIRE ADVANCING APPARATUS AND METHOD

BACKGROUND OF THE INVENTION

1. Field of the Invention

The present invention generally relates to a high speed and compact apparatus for advancing a wire in continual regular increments. In particular, the invention relates to a wire advancement device and method which consistently incrementally advances one or more lengths of wire a predetermined distance for subsequent cutting and placement into an electrical terminal or the like.

2. Description of Related Art

In the production of electrical connectors, it is necessary to place short lengths of wire into metal sleeves for use as terminal pins in the male portion of a connector. Together, the terminal pin and metal sleeve form a conductive male terminal. One or more of these male terminals may then be connected to a conductive wire and placed into a insulating housing for forming a male half of a connector. The terminal pins extend outward, and when the male half of the connector housing is assembled to a female connector housing half, the terminal pins are inserted into conductive socket-type terminals in the female half of the connector for forming an electrical connection.

During assembly of the conductive male terminals, the short lengths of wire are placed into the metal sleeves and then crimped, spot-welded, soldered, or otherwise secured in place within the sleeve. The sleeves may be formed by stamping operations from a strip of sheet metal in a stamping press, such as a reciprocating press with progressive dies. A large number of sleeves may be formed on a single strip of sheet metal, and the sleeves remain attached to the strip pending insertion of the wire pins. In an alternative use of the invention, the short lengths of wire can be fed into a bandoleer—a strip of material used to temporarily hold products such as pins, resistors, and the like. The bandoleer can then be fed into an assembly machine or die which automatically inserts the pins into the above-mentioned sleeves or other products.

The present invention is particularly directed to an apparatus for consistently feeding lengths of wire into a stamping operation, although it will be apparent that the present invention is not limited to such a use, and may be used for advancing wire or other elongated stock items for any number of alternative purposes. In the preferred use, the free end of the wire is fed into a terminal sleeve on a metal strip, and then clipped so that the portion of wire extending from the sleeve forms a terminal pin. Following insertion of the pin, the sleeve is then further crimped or otherwise tightened about the wire pin, and optionally spot-welded or soldered to hold the pin in position in the sleeve. The strip is then advanced, and the free end of the wire is inserted into the next sleeve in the strip, clipped, crimped, and so forth.

In the past, a number of devices have been implemented for feeding incremental lengths of stock material. While these devices worked well for their intended purposes, there remains a need for a more efficient, compact, and reliable device. The present invention provides such a device and method for advancing elongated stock material, such as a wire.

SUMMARY OF THE INVENTION

In the preferred form of the invention, an apparatus for advancing one or more lengths of wire in consistent successive increments includes a pair of cooperating gripper members. A first gripper and a second gripper are provided for advancing each length of wire, and are slideably located within a slot. A reciprocating press assembly having inclined surfaces is used to motivate the grippers. The inclined surfaces are inserted between the grippers and force the grippers to move away from each other during the downstroke of the press assembly. Load springs force the grippers back toward each other and aid in resetting the grippers and moving the wire. While one gripper grips and advances the wire, the second gripper is repositioning and not gripping the wire. The press assembly activates and advances one gripper during a downstroke, and activates and advances the other gripper during an upstroke. Also, during the downstroke, one inactive gripper is repositioned, while on the upstroke, the other inactive gripper is repositioned. Thus, the invention moves the wire one incremental distance during the downstroke, and a second incremental distance during the upstroke.

Accordingly, the present invention provides an efficient and compact device for incrementally advancing a length of wire in coordination with the movement of a press assembly. The present invention enables the wire to be incrementally advanced at greater speeds than was possible with previous devices. Also, because of the double action movement of the present invention which uses both the downstroke and upstroke, less force is required to advance the wire than would be the case with a single stroke. Because of the compact design of the present invention, the short stroke required, and the lower forces required, a number of apparatuses of the invention can be used side-by-side in a press or assembly machine to yield a plurality of terminal pins per cycle. For example, four apparatuses of the invention may be used with a terminal assembly machine to yield four terminal pins per single cycle of the press assembly. Further, while the preferred embodiment of the invention may be used in conjunction with assembling an electrical terminal, it can also be used for a variety of other purposes, and is not limited to the manufacture of electrical terminals.

BRIEF DESCRIPTION OF THE DRAWINGS

The foregoing and additional objects, features, and advantages of the present invention will become apparent to those of skill in the art from a consideration of the following detailed description of a preferred embodiment of the invention, taken in conjunction with the accompanying drawings.

DETAILED DESCRIPTION OF THE INVENTION

Figure 1:
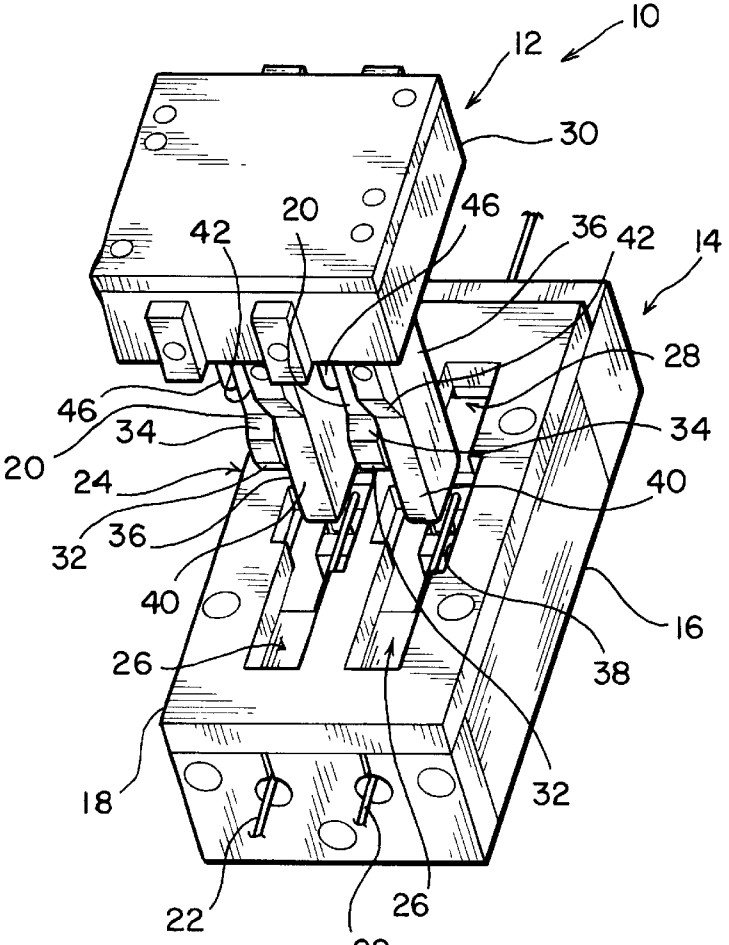
FIG. 1 is a perspective view of a wire advancing device in accordance with the preferred embodiment of the present invention.

Turning now to a more detailed description of the present invention, there is illustrated in FIG. 1 a preferred embodiment of a device 10 of the present invention for advancing a wire or the like. Device 10 includes a reciprocating press assembly 12 which cooperates with a fixed assembly 14. Fixed assembly 14 includes a generally rectangular block 16 having a cap plate 18 mounted on its upper surface by bolts (not shown) or the like. Press assembly 12 is able to reciprocally move into and out of fixed assembly 14 for incrementally advancing one or more elongate lengths of wire 22. The preferred embodiment of device 10 illustrated is configured for advancing two wires 22 simultaneously, and thus, includes two complete apparatuses of the invention. However, as will become apparent, the invention may be used to advance only one wire, or any number of wires, as desired, with the subtraction or addition of duplicate apparatuses.

Press assembly 12 is reciprocated up and down by a motive means (not shown). Motive means may be an electric motor with appropriate linkage, a hydraulic or pneumatic cylinder, a solenoid, or other suitable known means. In the preferred use, press assembly 12 is attached to the moving portion of a stamping press (not shown), so that advancement of wire 22 is coordinated with a stamping operation. As press assembly 12 reciprocates relative to fixed assembly 14, a driver device 36 and a plunger 20 cooperate to motivate a first gripper 26 and a second gripper 28 for advancing wire 22 in a desired direction.

Figure 3:
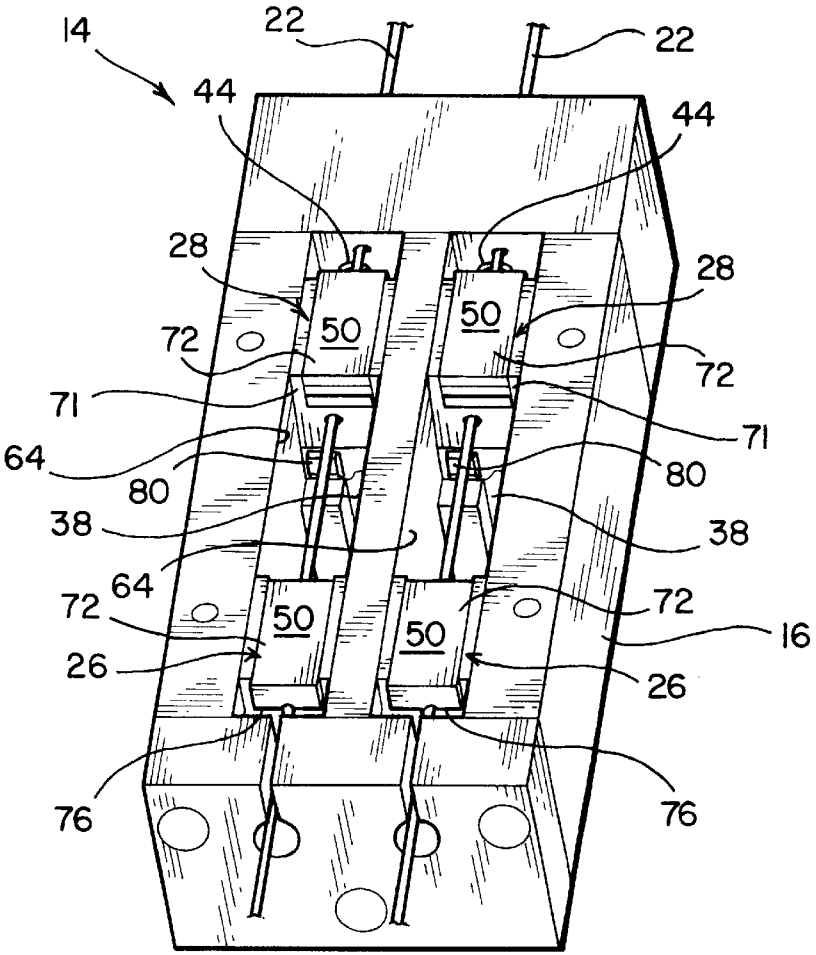
FIG. 3 is an enlarged perspective view of the fixed assembly of FIG. 1, with the cap plate removed.
Figure 2:
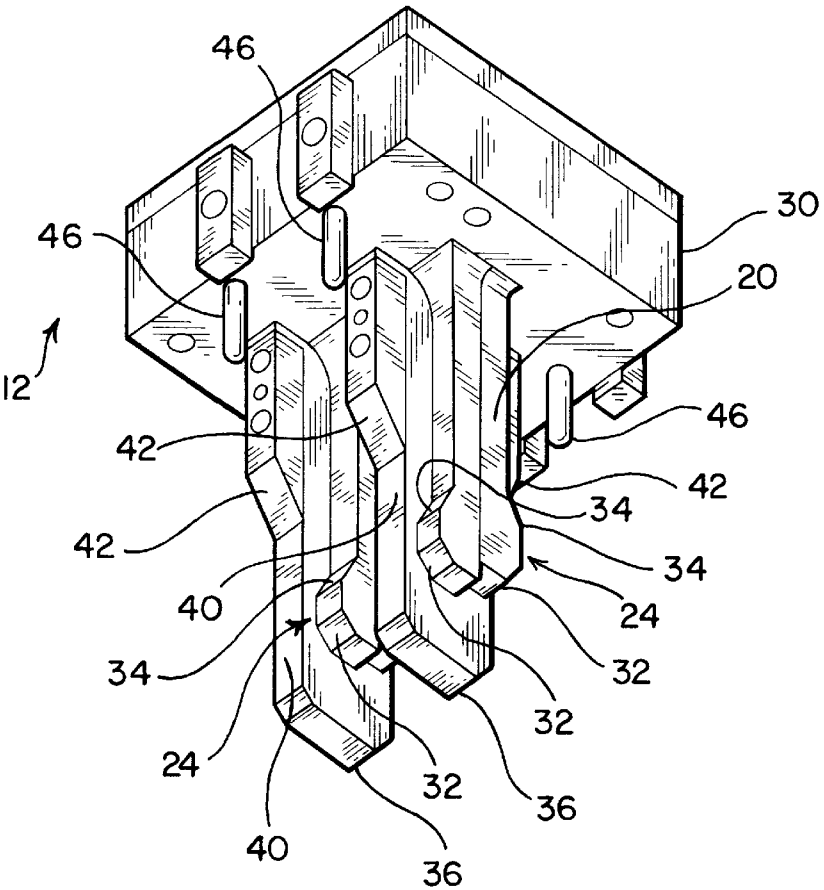
FIG. 2 is a reverse-angle perspective view of the press assembly of FIG. 1.
Figure 4B:
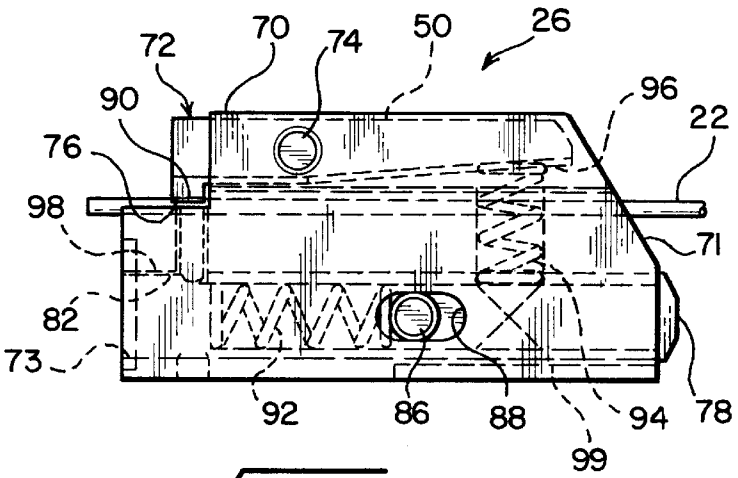
FIG. 4*b* is a side view of the gripper of FIG. 4*a*.
Figure 4D:
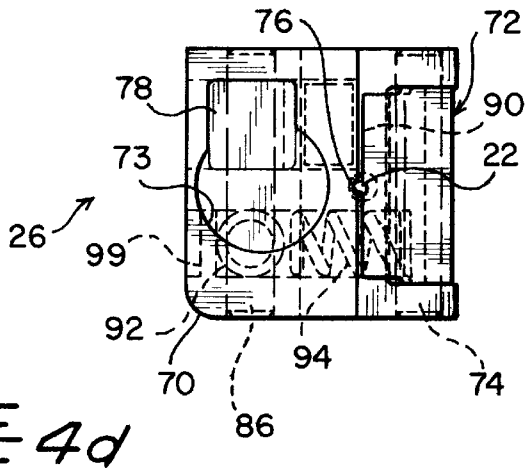
FIG. 4*d* is an end view of the gripper of FIG. 4*c*.
Figure 4A:
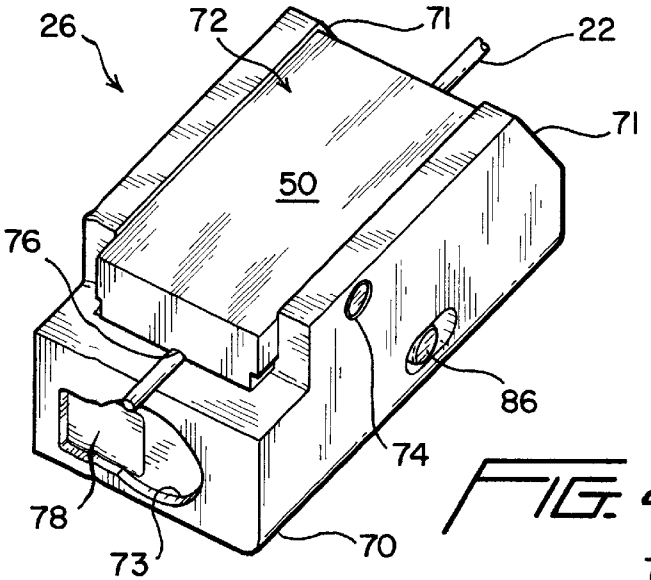
FIG. 4*a* is a perspective view of a first gripper of the present invention.
Figure 4C:
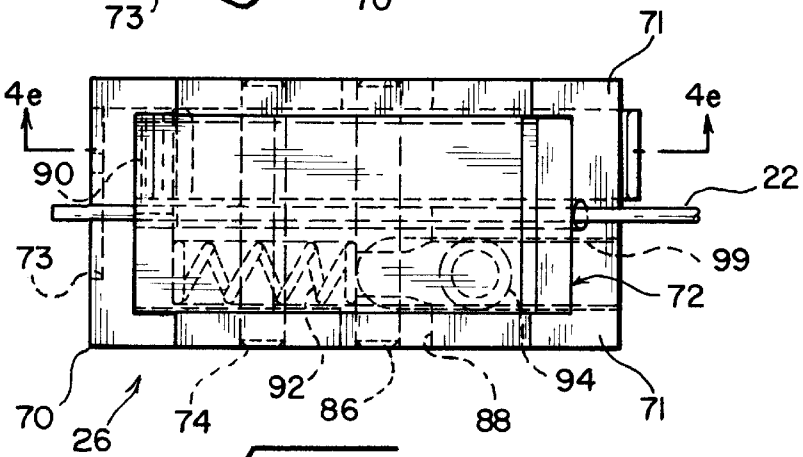
FIG. 4*c* is a top view of the gripper of FIG. 4*a*.
Figure 5B:
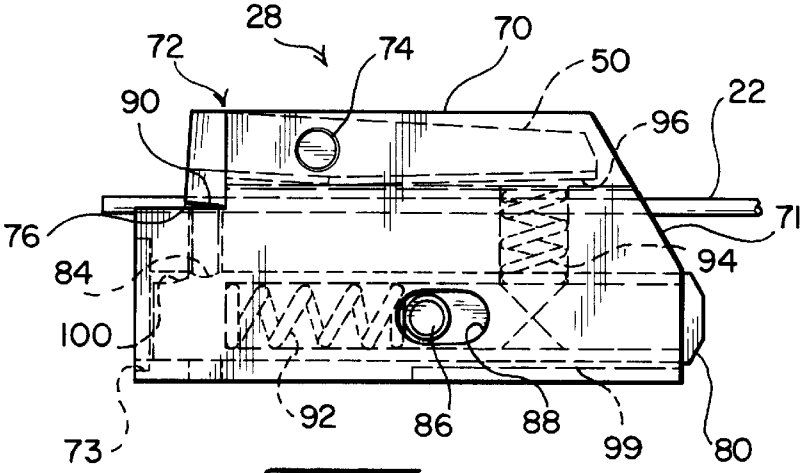
FIG. 5*b* is a side view of the gripper of FIG. 5*a*.
Figure 5D:
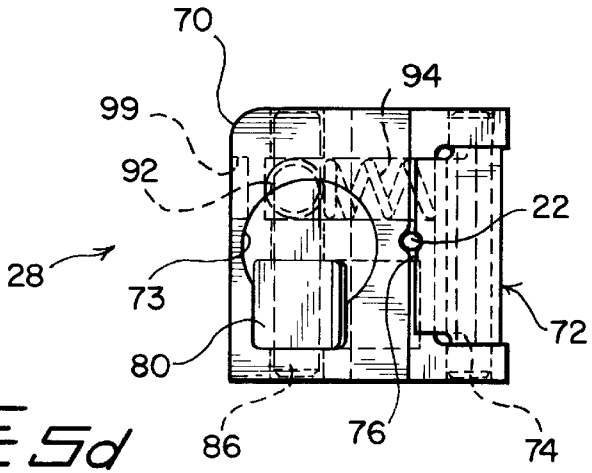
FIG. 5*d* is an end view of the gripper of FIG. 5*c*.
Figure 5A:
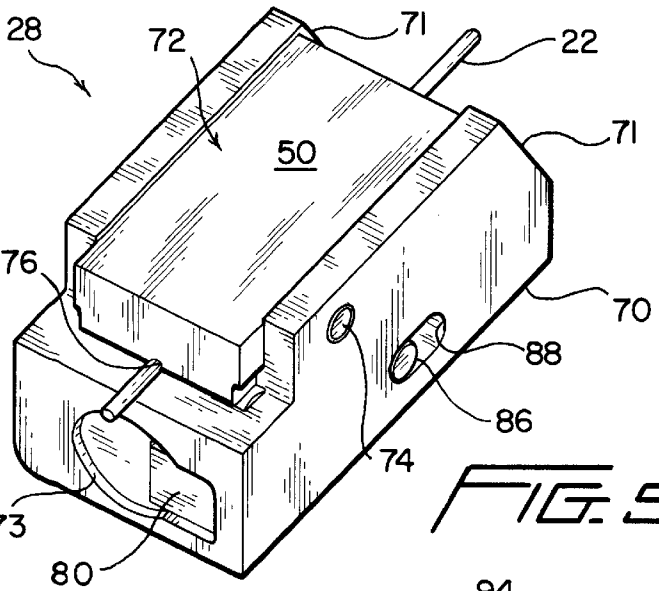
FIG. 5*a* is a perspective view of a second gripper of the present invention.
Figure 5C:
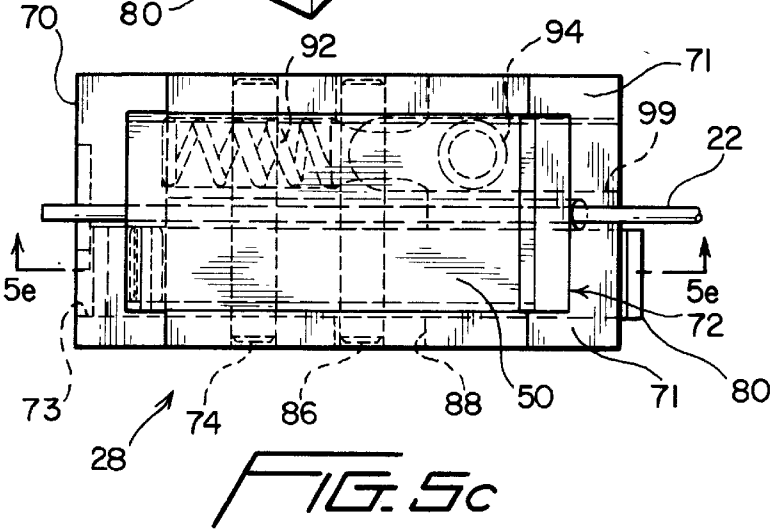
FIG. 5*c* is a top view of the gripper of FIG. 5*a*.

FIG. 2 illustrates a reverse-angle view of press assembly 12, and further illustrates a pair of plungers 20 which project downward from a press block 30. Plunger 20 includes a cammed area 24 which is positioned for contacting and resetting grippers 26, 28 during the upstroke of the cycle, as will be described in more detail below. Cammed area 24 includes lower cammed surfaces 32 and upper cammed surfaces 34 for contacting a gripper 26, 28 on the downstroke or upstroke, respectively, of plunger 20. Adjacent to plunger 20 there is located driver device 36 which fits within a clearance slot 38 located in fixed assembly 14, as also illustrated in FIG. 3. There is sufficient clearance between driver device 36 and plunger 20 to allow passage of wire 22. Thus, wire 22 passes between driver device 36 and plunger 20 as press assembly 12 reciprocates up and down.

Located on the lateral edges 40 of driver device 36 are a pair of inclined surfaces 42. Inclined surfaces 42 are positioned to contact grippers 26, 28 during a downstroke of press assembly 12. As inclined surfaces 42 contact grippers 26, 28, they force grippers 26, 28 outward and away from each other and from driver device 36. This movement of grippers 26, 28 also moves wire 22 a predetermined distance, since first gripper 26 will have a grip on wire 22 during this portion of the downstroke. Following completion of the downstroke, first gripper 26 gripping wire 22 is deactivated so that wire 22 is released, and second gripper 28 is activated to grip wire 22. Then, as inclined surfaces 42 are withdrawn during the upstroke, load springs 44, mounted to move grippers 26, 28 toward each other, force grippers 26, 28 back inward toward plunger 20. This moves wire 22 an additional predetermined distance as second gripper 28, gripping wire 22, moves back toward the center of fixed assembly 14.

Cammed area 24 on plunger 20 aids in the resetting of grippers 26, 28 at the appropriate time in the cycle. Also for aiding in the activation and deactivation of each pair of grippers 26, 28, are a pair of activation rods 46. Activation rods 46 project downward from press block 30 and contact gripper switch surfaces 50 for switching first gripper 26 from the locked condition to the unlocked condition, while simultaneously switching second gripper 28 from the unlocked condition to the locked condition. In the locked condition, grippers 26, 28 securely grip wire 22, while in the unlocked condition, wire 22 is able to slide freely relative to grippers 26, 28.

Fixed assembly 14 includes rectangular block 16 which may be mounted to the machinery, such as a stamping press, with which device 10 is to be used. A cap plate 18 is mounted to fixed block 16 for retaining grippers 26, 28 within a gripper slot 64 located in block 16. Grippers 26, 28 are able to slide back and forth withing gripper slot 64, away from each other and driver device 36 and back toward each other. One load spring 44 is mounted between each gripper 26, 28, and the inner end walls of gripper slot 64 in block 16. Load springs 44 urge grippers 26, 28 toward the center of fixed block 16, i.e., toward each other, plunger 20, and inclined surfaces 42 during operation of device 10. Load springs 44 are of sufficient strength to move grippers 26, 28, and also to move wire 22 when gripped by second gripper 28 during a portion of the cycle.

Grippers 26, 28 are illustrated in FIGS. 4*a*–4*e* and 5*a*–5*e*, respectively. Grippers 26, 28 are essentially mirror images of each other in many respects. However, since it is desired that first gripper 26 be in the locked condition on the downstroke, and that second gripper 28 be in the locked condition on the upstroke of press assembly 12 some parts differ. Accordingly, similar parts have been given the same reference number, and parts that differ have been given differing reference numbers.

Each gripper 26, 28 includes a housing 70 which is sized exteriorly to fit within gripper slot 64 on fixed assembly 14, and slide back and forth therein. Housing 70 includes ramped surfaces 71 on its forward end for engaging with inclined surfaces 42 on press assembly 12 during operation of device 10. Housing 70 further includes a load-spring relief 73 on its rear side for receiving one end of load spring 44 when grippers 26, 28 are mounted in gripper slot 64. A switch 72 is located on the top of each gripper 26, 28, and is pivotally mounted by a switch pin 74 for enabling movement of switch 72 between a locked position and an unlocked position. Switch 72 includes a wire gripping edge 76 which engages with wire 22 when switch 72 is in the locked position. The locked condition of switch 72 is illustrated by gripper 26 of FIGS. 4*a*–4*d*. Wire 22 passes beneath gripping edge 76 when installed, and passes through a hole located in housing 70. When switch 72 is in the unlocked position, as illustrated by gripper 28 in FIGS. 5*a*–5*d*, wire 22 is free to slide beneath gripping edge 76.

Figure 4E:
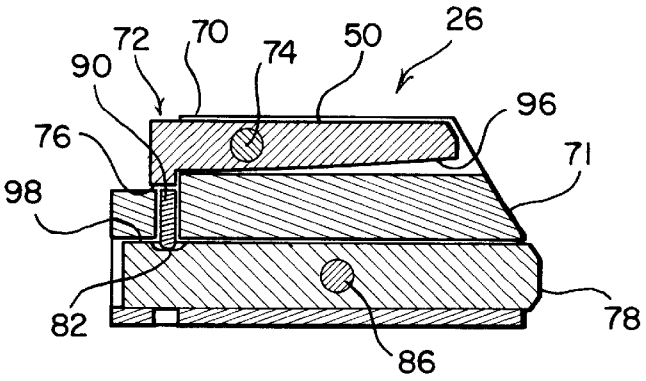
FIG. 4*e* is a cross-sectional view taken along line 4*e*—4*e* of FIG. 4*c*.
Figure 5E:
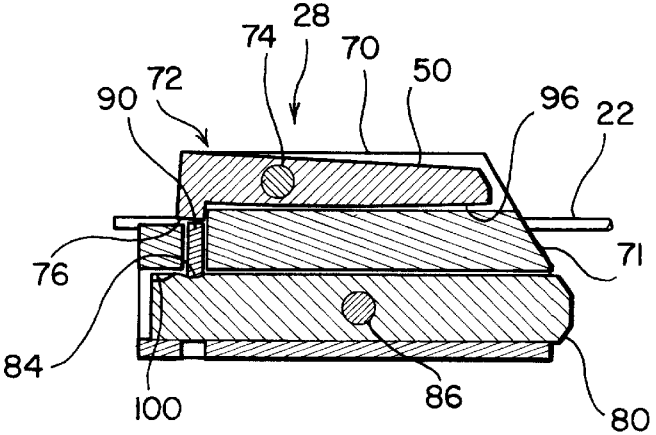
FIG. 5*e* is a cross-sectional view taken along line 5*e*—5*e* of FIG. 5*c*.

A first cocking button 78, is slideably mounted in first gripper 26, and a second cocking button 80 is slideably mounted in second gripper 28. Cocking buttons 78, 80 are elongated slideable rods which have detents 82, 84, respectively, located on the rear portion thereof. As illustrated in FIGS. 4*e* and 5*e*, first detent 82 on cocking button 78 in first gripper 26 is shaped differently from second detent 84 on cocking button 80 in second gripper 28, as will be described in more detail below. A detent pin 90 resides within housing 70, and is able to enter into detents 82, 84. Detent pin 90 also is in contact with gripping edge 76 and is able to lift gripping edge 76 when raised by the movement of cocking buttons 78, 80. Cocking buttons 78, 80 are retained within housing 70 by a button pin 86 located within opposed slots 88. Cocking buttons 78, 80 are able to extend and retract, as limited by the movement of button pin 86 within opposed slots 88. A button spring 92 is located adjacent to each button 78, 80 and bears against button pin 86 for urging cocking buttons 78, 80 toward the forward end of housing 70. A switch spring 94 is also located within housing 70 for bearing against the underside 96 of switch 72. Switch spring 94 bears against underside 96 thereby urging gripping edge 76 toward wire 22, creating a gripping force on wire 22. This gripping force may be countered by detent pin 90 to raise gripping edge 76 away from wire 22 when cocking buttons 78, 80 are in the proper position with respect to detent pin 90.

First detent 82 on first cocking button 78 of first gripper 26 is shaped to retain cocking button 78 in a retracted or cocked position wherein detent pin 90 will hold cocking button 78 in the retracted position, as illustrated in FIGS. 4*a*–4*d*. When first cocking button 78 is in the retracted position, and detent pin 90 is in first detent 82, detent pin 90 does not prevent gripping edge 76 from clamping against wire 22. Thus, when first cocking button is in the retracted position, as illustrated in FIGS. 4*a*–4*e*, gripping edge 76 clamps against wire 22, and wire 22 is immobilized relative to first gripper 26. However, if switch 72 on first gripper 26 is depressed, detent pin 90 is able to rise up out of detent 82 and button spring 92 forces first cocking button 78 forward. As first cocking button 78 moves forward, a raised surface 98 moves underneath detent pin 90, raising detent pin 90, and thereby holding gripping edge 76 away from wire 22. The contact of detent pin 90 with gripping edge 76 prevents gripping edge 76 from engaging with wire 22. Thus, when first cocking button 78 is in the forward or extended position, gripping edge 76 is raised, and wire 22 is free to move relative to gripper 26. However, if first cocking button 78 is pushed rearward to the retracted position, either manually, or by a cammed surface 32, 34 on plunger 20, then detent pin 90 will again enter first detent 82. When detent pin 90 is again in first detent 82, gripping edge 76 is able to engage and clamp against wire 22 under the force of switch spring 94, thereby immobilizing wire 22 relative to first gripper 26.

Similarly, second gripper 28 includes a second detent 84 in second cocking button 80. However, detent 84 is located in a relatively higher position than first detent 82 so that when detent pin 90 is located in second detent 84, gripping edge 76 is in the raised or unlocked position. Thus, when second cocking button 80 is in the retracted position, wire 22 is free to move relative to second gripper 28. If switch 72 is depressed further, button spring 92 is able to force second cocking button 80 forward to the extended position. When second cocking button 80 is in the extended position, an indented surface 100 is located under detent pin 90. In this position, detent pin 90 does not prevent gripping edge 76 from contacting and clamping against wire 22. Accordingly, when second cocking button 80 is in the forward position, gripping edge 76 clamps against wire 22 so that wire 22 will move with second gripper 28. From the foregoing it may be seen that first gripper 26 acts in an opposite manner from second gripper 28 because of the differing configurations of first detent 82 from second detent 84 and raised surface 98 from indented surface 100. Thus, when the cocking buttons 78, 80 are in the retracted position, wire 22 is gripped by first gripper 26 and free to move relative to second gripper 28. However, when cocking buttons 78, 80 are in the extended position, wire 22 is free to move relative to first gripper 26 and is gripped by second gripper 28.

In use, as illustrated in FIGS. 6*a*–6*e*, grippers 26, 28 are manually cocked prior to the start of the first cycle. In this condition, cocking buttons 78, 80 are in the retracted position and first gripper 26 is clamping wire 22, while wire 22 is free to move relative to second gripper 28. If grippers 26, 28 are not properly cocked prior to insertion of plunger 20, lower cammed surfaces 32 may accomplish this function as plunger 20 is inserted between grippers 26, 28. Lower cammed surfaces will contact cocking buttons 78, 80 and force them inward until detent pins 90 enter detents 82, 84. It might be further noted that stop pins 97 are included in block 16 within slot 64 for limiting the movement of grippers 26, 28 toward each other. Stop pins 97 are dowel-type pins pressed into holes formed in the appropriate location in block 16. Each housing 70 for grippers 26, 28 includes a stopping groove 99 located on its underside for receiving stop pin 97. Stop pin groove 99 enables grippers 26, 28 to move away from each other, but limits the movement of grippers 26, 28 toward each other. Thus, even when press assembly 12 is removed from fixed assembly 14, the movement of grippers 26, 28 toward the center of fixed assembly 14 is limited by stop pins 97.

Figure 6A:
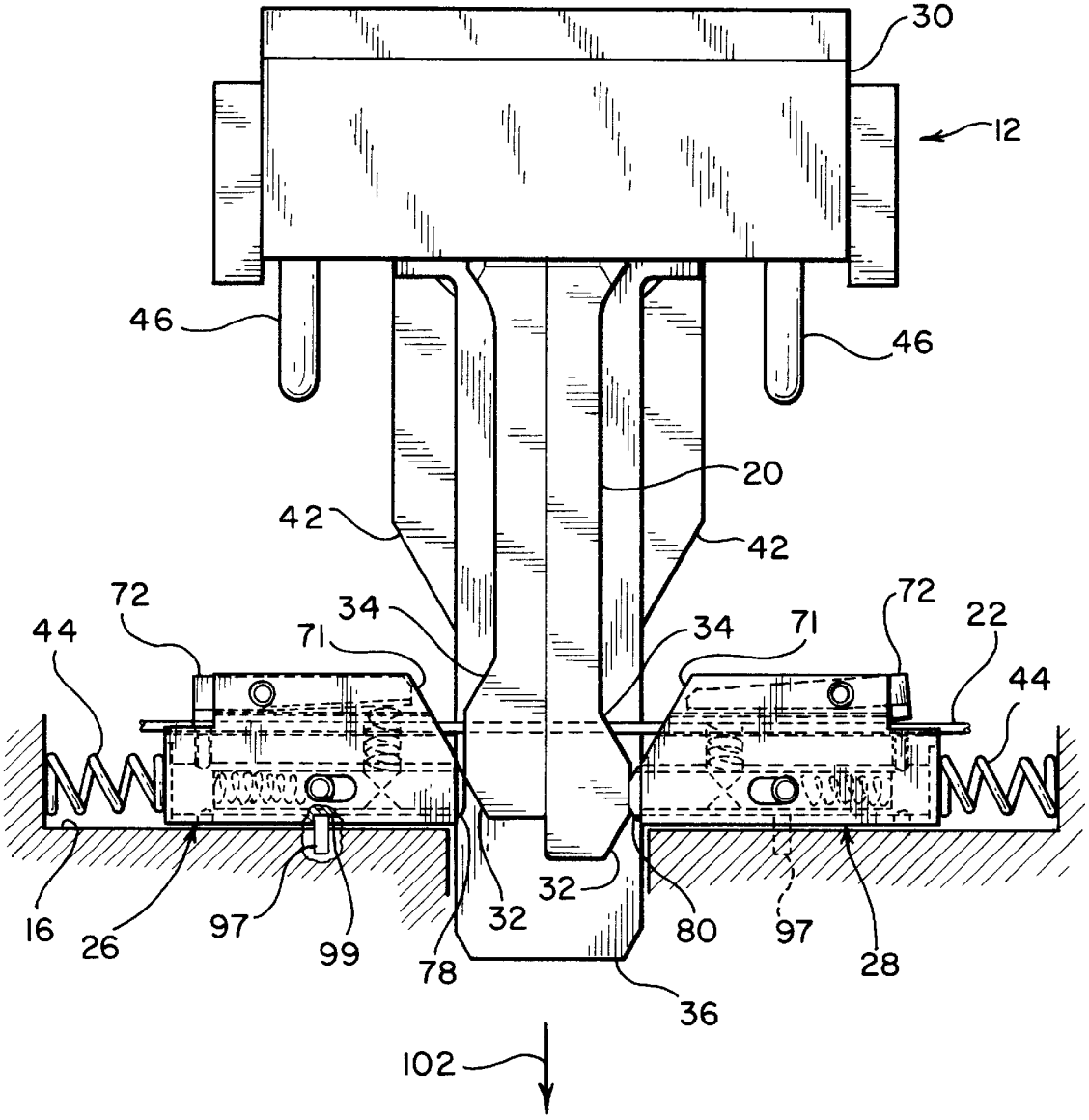
FIG. 6*a* illustrates the functioning of the apparatus of the invention with the press assembly at the beginning of a downstroke.
Figure 6B:
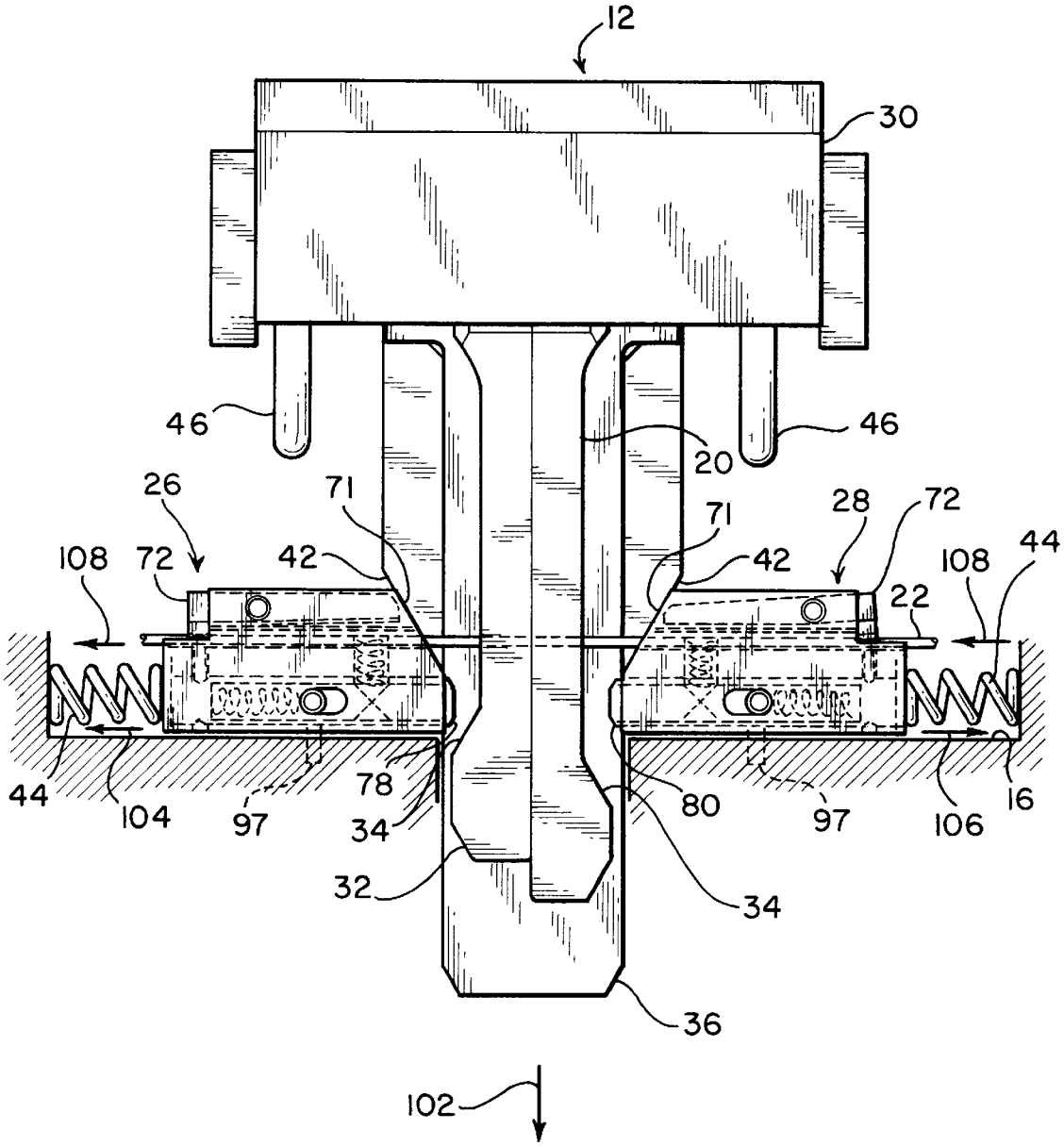
FIG. 6*b* illustrates the apparatus of the invention during a downstroke with the grippers being forced away from each other.

FIG. 6*a* illustrates the start or finish position of a wire advancement cycle. To start a cycle, press assembly 12 is moved downward in the direction of arrow 102. As illustrated in FIG. 6*b*, as press assembly 12 descends, inclined surfaces 42 contact ramped surfaces 71 on gripper housings 70. The inclined surfaces 42 force grippers 26, 28 outward away from each other, plunger 20, and driver device 36, in the direction of arrows 104 and 106, respectively. Since first gripper 26 is gripping wire 22, wire 22 moves with first gripper 26, in the direction illustrated by arrows 108.

Figure 6C:
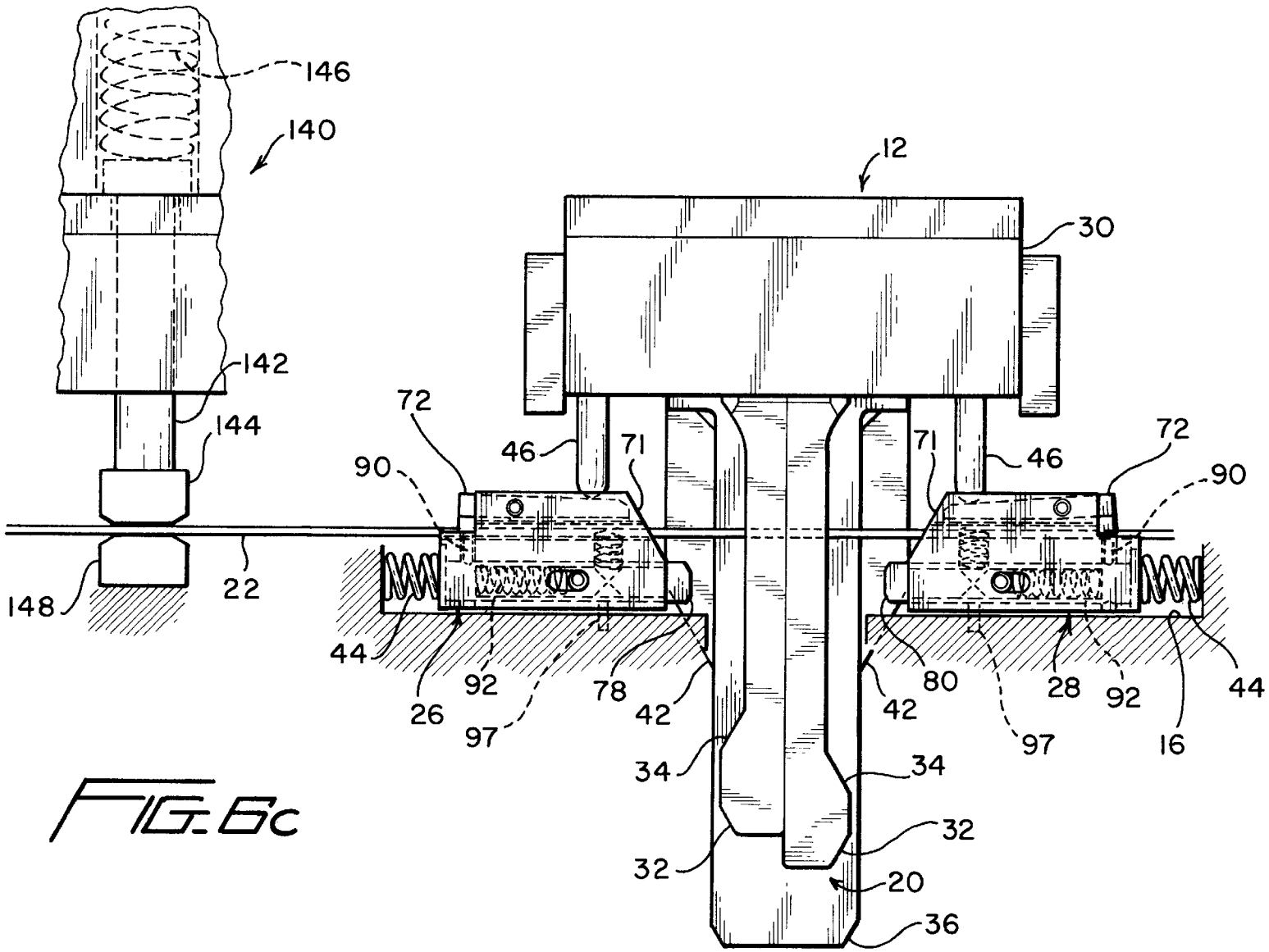
FIG. 6*c* illustrates the apparatus of the invention with the press assembly at the bottom of the downstroke, and also illustrating an auxiliary gripping device for immobilizing the wire while the apparatus of the invention is in the position shown.

Press assembly 12 continues to descend until activation rods 46 contact switches 72 on grippers 26, 28, as illustrated in FIG. 6*c*. When activation rods 46 depress switches 72, detent pins 90 are released, and cocking buttons 78, 80 spring outward under the force of button springs 92. In this position, the gripping action of both grippers 26, 28 on wire 22 is released. Also, at this point grippers 26, 28 have been moved outward the full width of inclined surfaces 42. Accordingly, wire 22 has been advanced a distance equal to the width of one of inclined surfaces 42, which is 0.315 inches in the preferred embodiment.

Under the best mode of the invention, when press assembly 12 is at the bottom of the downstroke, as illustrated in FIG. 6*c*, an auxiliary gripping device 140 is preferably used to momentarily hold wire 22 immobile. Auxiliary gripping device 140 includes a reciprocally-movable spring-loaded gripping pin 142 having a gripping pad 144 mounted on its lower end and a pin spring 146 located at its upper end. Gripping pin 142 moves in coordination with the movement of press assembly 12, and, in the preferred environment of use of the invention, may be part of the progressive die (not shown). The reciprocal movement of gripping pin 142 clamps wire 22 between gripping pad 144 and a fixed pad 148 at the moment when press assembly 12 is at the bottom of its downstroke, as illustrated in FIG. 6*c*. Auxiliary gripping device 142 is desirable because at this position neither of grippers 26 and 28 are clamping wire 22. Thus, auxiliary gripping device 140 ensures that wire 22 does not move during this time period and thereby ensures that control over wire 22 is maintained. This guarantees repeatable incremental advancement of wire 22 a precise distance during each cycle of the invention. As press assembly 12 begins its upstroke, and wire 22 is subsequently gripped by second gripper 28, gripping pin 142 is moved upward and releases its hold on wire 22 so that wire 22 may be advanced further by the apparatus of the invention. In addition, the invention may be used without auxiliary gripping device 140, but the lack of precise control over wire 22 may result in variations in the distance that wire 22 is advanced by each cycle of press assembly 12.

Figure 6D:
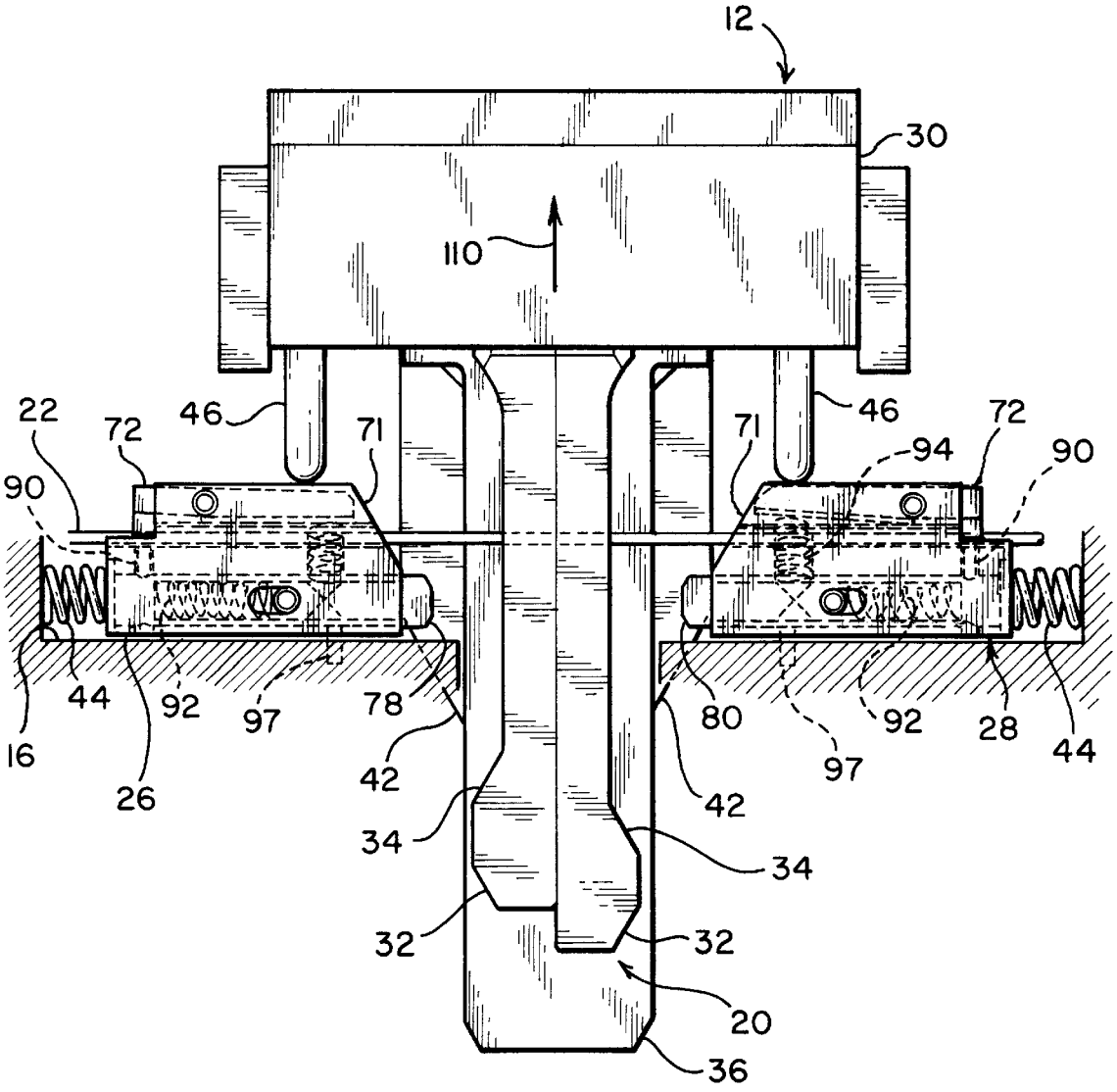
FIG. 6*d* illustrates the apparatus of the invention with the press assembly at the beginning of an upstroke.
Figure 6E:
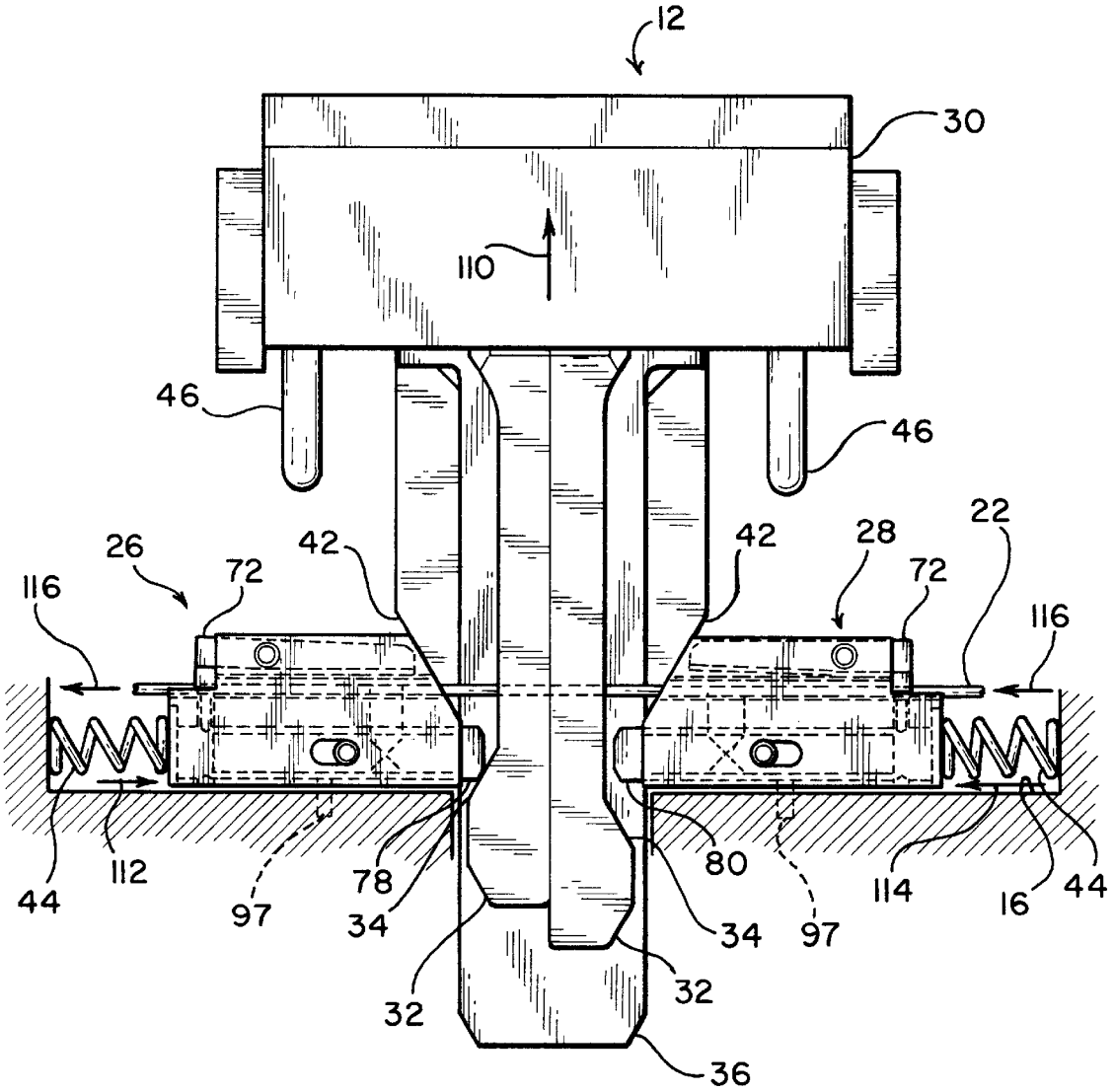
FIG. 6*e* illustrates the apparatus of the invention during the upstroke with the grippers being forced toward each other by the load springs.

Following the downstroke, press assembly 12 begins an upward stroke in the direction of arrow 110, as illustrated in FIG. 6*d*. As press assembly 12 moves upward and the activation rods 46 break contact with switches 72, switch spring 94 on second gripper 28 forces switch 72 to clamp against wire 22 so that second gripper 28 now grips wire 22. As illustrated in FIG. 6*e*, as inclined surfaces 42 move upward, load springs 44 force grippers 26, 28 back toward each other, plunger 20, and driver device 36, as illustrated by arrows 112, 114, respectively. Since second gripper 28 is gripping wire 22 during this motion, wire 22 moves with gripper 28, in the direction of arrows 116. This advances wire 22 an additional distance equal to the width of one of inclined surfaces 42, i.e., an additional 0.315 inches in the preferred embodiment. As press assembly 12 continues its upper motion, upper cammed surfaces 34 contact cocking buttons 78, 80. This forces cocking buttons 78, 80 inward, thereby resetting grippers 26, 28 to the configuration shown in FIG. 6*a*. Also, it should be noted that the upper cammed surface 34 which contacts first cocking button 78 of first gripper 26 is slightly elevated or offset relative to the upper cammed surface 34 which contacts second cocking button 80 of second gripper 28. This ensures release of wire 22 by second gripper 28 after clamping of wire 22 by first gripper 26.

Following completion of the upstroke, the apparatus is once again in the condition shown in FIG. 6*a*, and ready for another immediate downstroke. Wire 22 has been advanced a total distance equal to the combined widths of two inclined surfaces 42, with wire 22 being advanced one half of the total distance on the downstroke, and then being advanced the other half of the total distance on the upstroke. In the preferred embodiment, wire 22 is advanced a total of 0.630 inches per cycle. The invention is designed to operate a high rate of cycles per minute, with 700 cycles per minute being a preferred operating speed. Of course, these numbers are only exemplary, and may be varied within a large range since the actual application of the invention will determine these and other parameters.

From the foregoing it will be apparent that there is provided a novel wire advancing device and method for consistently incrementally advancing a wire or similar stock item. The device includes a cammed plunger and cooperating grippers which advance the wire one increment on the downstroke of the plunger and a second increment on the upstroke of the plunger. The arrangement of the invention provides an efficient and compact design which uses both the downstroke and the upstroke to advance the wire. Since the wire is advanced in two increments, rather than in a single action, less force is placed on the wire. Also, because of the compact nature of the design, any number of identical mechanisms may be placed side-by-side to advance any desired number of wires simultaneously. Furthermore, the design enables the rapid and accurate advancement of wire at speeds greater than those possible with prior art devices. Accordingly, the wire advancing mechanism of the present invention provides substantial advantages over those of the prior art. In addition, although the present invention has been described in terms of preferred embodiments, it will be apparent that variations and modifications may be made without departing from the true spirit and scope thereof, as set forth in the following claims.

What is claimed:

1. An apparatus for incrementally advancing a length wire, said apparatus comprising:

a reciprocating press assembly having a pair of inclined surfaces projecting therefrom;

a first gripper for releasably gripping the wire, said gripper being located on a first side of said inclined surfaces, and being spring biased toward said inclined surfaces; and a second gripper for releasably gripping the wire, said gripper being located on a second side of said inclined surfaces opposed to said first gripper, and also being spring biased toward said inclined surfaces;

whereby said press assembly is configured to reciprocate one said inclined surface into contact with said first gripper and the other said inclined surface into contact with said second gripper, and further whereby said first gripper is configured to grip the wire on a downstroke of said press assembly as said inclined surfaces contact said first and second grippers and force said first and second grippers away from each other, while said second gripper is configured to grip the wire on an upstroke of said press assembly as said spring bias moves said first and second grippers back toward each other, whereby the wire is advanced a first increment on said downstroke and a second increment on said upstroke.

2. The apparatus of claim 1 further including a plunger projecting from said press assembly, said plunger including a cammed surface for contacting said grippers during said upstroke for resetting said grippers for the next downstroke by causing said second gripper to release the wire and causing the first gripper to grip the wire.

3. The apparatus of claim 2 further including a first cocking button located in said first gripper and a second cocking button located in said second gripper, said first cocking button being configured to be depressed by said plunger for causing said first gripper to grip the wire, and said second cocking being configured to be depressed by said plunger for causing said second gripper to release the wire.

4. The apparatus of claim 1 further including switches on said first and second grippers, said switches being configured to cause said first gripper to release the wire when depressed and causing said second gripper to grip the wire when depressed.

5. The apparatus of claim 4 further including activation rods projecting from said press assembly for contacting and depressing said switches.

6. The apparatus of claim 1 wherein said inclined surfaces are located on a driver device, with one inclined surface being located on one side of said driver device, and the other inclined surface being located on the opposite side of said driver device.

7. The apparatus of claim 1 further including a fixed assembly having a slot for receiving said first and second grippers in a slideable fashion, said press assembly being reciprocal relative to said fixed assembly.

8. The apparatus of claim 7 further including a plunger projecting from said press assembly, said plunger including a cammed surface for contacting said grippers during said upstroke for resetting said grippers for the next downstroke by causing said second gripper to release the wire and causing the first gripper to grip the wire.

9. The apparatus of claim 8 further including a first cocking button located in said first gripper and a second cocking button located in said second gripper, said first cocking button being configured to be depressed by said plunger for causing said first gripper to grip the wire, and said second cocking being configured to be depressed by said plunger for causing said second gripper to release the wire.

10. A method of incrementally advancing a wire, said method comprising:

providing a reciprocal press assembly;

providing a first gripper for releasably gripping the wire, and a second gripper for releasably gripping the wire, said grippers being spring biased toward each other;

causing said first gripper to grip said wire while said second gripper does not grip the wire; and moving said press assembly between said grippers to force said grippers away from each other, thereby causing said first gripper to advance said wire.

11. The method of claim 10 further including the step of causing said second gripper to grip the wire, while said first gripper releases the wire; and further advancing the wire by withdrawing said press assembly and enabling said spring bias to move said second gripper back toward said first gripper.

12. The method of claim 11 further including the step of resetting said grippers during removal of said press assembly so that said second gripper releases the wire and said first gripper again grips the wire so that a second cycle may begin.

13. The method of claim 12 further including the step of repeating the foregoing steps to carry out a second cycle.

14. An apparatus for advancing a length of wire, said apparatus comprising:

a fixed assembly having a slot therein;

a first gripper slideably located in said slot, said first gripper having a switchable gripping edge for selectively releasably clamping against the wire;

a second gripper slideably located in said slot opposed to said first gripper, said second gripper having a switchable gripping edge for selectively releasably clamping against the wire;

a first spring in contact with said first gripper for urging said first gripper toward said second gripper;

a second spring in contact with said gripper for urging said second gripper toward said first gripper;

a press assembly, said press assembly having a first inclined surface positioned for reciprocating contact with said first gripper and a second inclined surface positioned for reciprocating contact with said second gripper; whereby, said inclined surfaces may be inserted between said first gripper and said second gripper for moving said first gripper and said second gripper away from each other, so that as said grippers are moved, said wire is advanced by being engaged with one of said first or second gripping edges.

15. The apparatus of claim 14 further including stop pins mounted in said slot for limiting the movement of said grippers toward each other.

16. The apparatus of claim 14 further including a pair of activation rods projecting from said press assembly for contacting switching surfaces located on said grippers for switching one said gripper from a clamping engagement with the wire to a non-clamping mode, while simultaneously switching the other said gripper from a non-clamping mode to a clamping engagement with the wire.

17. The apparatus of claim 16 wherein said grippers include cocking buttons for switching one said gripper from an engagement with the wire to non-engagement with the wire and for switching the other said gripper from non-engagement with the wire to engagement with the wire.

18. The apparatus of claim 17 wherein said press assembly includes a plunger having cammed surfaces, said cammed surfaces being configured for engaging with said cocking buttons during an upstroke of said press assembly.

19. The apparatus of claim 17 wherein each said cocking button includes a detent for receiving a detent pin, said detent pin also being engageable with said gripping edge.

20. The apparatus of claim 19 wherein one of said cocking buttons includes a raised area adjacent said detent and the other said cocking button includes a recessed area adjacent said detent.

* * * * *